US005788124A

United States Patent [19]

Bougamont et al.

[11] Patent Number: 5,788,124

[45] Date of Patent: Aug. 4, 1998

[54] DEVICE FOR PACKAGING AND DISPENSING A LIQUID OR SEMI-LIQUID SUBSTANCE

[75] Inventors: Jean-Louis Bougamont, Eu; Pierre Dumont, Houdain; Hervé Lompech, Incheville; Pierre Amiel, Neuilly Sur Seine, all of France

[73] Assignee: SOFAB, Le Treport, France

[21] Appl. No.: 631,001

[22] Filed: Apr. 12, 1996

[30] Foreign Application Priority Data

Apr. 13, 1995 [FR] France ..... 95 04452

[51] Int. Cl.[6] ..... B67D 5/42

[52] U.S. Cl. ..... 222/207; 222/321.9; 222/260

[58] Field of Search ..... 222/207, 321.1, 222/321.7, 321.9, 256, 257, 260

[56] References Cited

U.S. PATENT DOCUMENTS

| | | | |
|---|---|---|---|
| 4,452,379 | 6/1984 | Bundschuh | 222/207 |
| 4,867,347 | 9/1989 | Wass et al. | 222/207 X |
| 4,875,604 | 10/1989 | Czech | 222/321.7 X |
| 5,152,434 | 10/1992 | Birmelin | 222/207 |
| 5,174,478 | 12/1992 | Reyman | 222/207 |
| 5,267,673 | 12/1993 | Crosnier et al. | 222/321.7 |
| 5,476,195 | 12/1995 | Oder et al. | 222/207 |
| 5,518,147 | 5/1996 | Peterson et al. | 222/207 X |
| 5,544,789 | 8/1996 | Gillingham | 222/207 X |

FOREIGN PATENT DOCUMENTS 0 286 608 12/1988 European Pat. Off. .

*Primary Examiner*—Kenneth Bomberg
*Attorney, Agent, or Firm*—Bacon & Thomas

[57] ABSTRACT

A device for packaging and dispensing a liquid or semi-liquid substance (P) in which a substance (P) in a receptacle (1), which is closed in a sealed manner firstly at a top by a cap (2) and secondly at a bottom by an internally movable punt (5), is compressed. The device includes an elastically deformable membrane (4) received in the top of the receptacle (1). The membrane (4) is formed by a substantially frustoconical axial valve (40) having a top portion provided with a central ejection orifice (41), a middle portion running into a channel section ring (42) and a bottom portion provided with a stretchable thin skirt (43) connected to a flange (44). The skirt (43) extends upwards along an internal wall of the receptacle (1). The flange (44) fixes the membrane (4) to the receptacle (1). A nozzle-forming tube (3) passes axially through the cap (2) of the receptacle (1). The tube (3) has a top end (31) projecting outside the receptacle (1) and an internal bottom end. The bottom end is provided with an element for bearing against the membrane (4) and a closure element (33) for closing the ejection orifice (41).

9 Claims, 2 Drawing Sheets

1
2
3
4
5
6
10
11
12
31
31a
32
32a
33
34
35
40
41
42
43
44
45
50
51
52
F
P

DEVICE FOR PACKAGING AND DISPENSING A LIQUID OR SEMI-LIQUID SUBSTANCE

BACKGROUND OF THE INVENTION

1. Field of the Invention

The present invention relates to a device for packaging and dispensing a liquid or semi-liquid substance.

2. Description of the Related Art

Packaging and dispensing devices exist which comprise, in particular, compression means for compressing a substance in a receptacle that is closed in a sealed manner, firstly at a top end by a cap having a nozzle-forming tube passing axially therethrough with a top end of the tube projecting outside of the receptacle and secondly at a bottom end by an internally movable end wall or "punt".

However, in conventional devices, the compression means generally comprise a pump fitted with a return spring.

Unfortunately, the presence of such a pump makes the device complex and expensive insofar as it then comprises an assembly of a large number of parts made out of a variety of different materials.

An object of the present invention is to solve the above technical problems in a satisfactory manner.

SUMMARY OF THE INVENTION

According to the invention, this object is achieved by a device for packaging and dispensing a liquid or semi-liquid substance comprising means for compressing a substance in a receptacle that is closed in a sealed manner firstly at a top end of the receptacle by a cap having a nozzle-forming tube passing axially therethrough with a top end of the tube projecting outside of the receptacle and secondly at a bottom end of the receptacle by an internally movable punt. The compression means comprises an elastically deformable membrane pierced by a central ejection orifice and received in the top of the receptacle. An internal bottom end of the tube is provided with an element for bearing against the membrane and with a closure element for closing the ejection orifice.

According to an advantageous characteristic, the membrane comprises a substantially frustoconical axial valve having a top portion provided with the ejection orifice, a middle portion running into a channel section ring and a bottom portion provided with a stretchable thin skirt connected to a flange. The skirt extends upwards along an internal wall of the receptacle. The flange fixes the membrane to the receptacle.

In a particular embodiment, the cap covers the top of the receptacle, holding captive the flange for fixing the membrane.

According to another characteristic, the element for bearing against the membrane comprises a peripheral hood surrounding the element for closing the ejection orifice.

A bottom edge of the hood is preferably a tapering rim.

According to yet another characteristic, the element for closing the ejection orifice comprises a central nose surrounded by a cavity which communicates with an internal duct of the tube via at least one lateral opening.

In another aspect of the invention, the movable punt comprises an element that slides toward the tube and is self-locking. The element is substantially cylindrical in shape and has a convex and elastically deformable top wall designed to be continuously in contact with the substance and has a peripheral side wall designed to jam against an internal side face of the receptacle.

Preferably, a peripheral edge of the top wall of the movable punt has a profile that serves both to scrape the substance on the internal side face of the receptacle when the punt slides toward the tube to seal the bottom of the receptacle.

In a complementary variant, the movable punt also includes, beneath the wall, a set of downwardly sloping flexible blades. The blades have ends which bear against the internal side face of the receptacle to reinforce the locking of the punt.

Finally, provision is made for the top end of the tube to be covered by a dispensing endpiece.

The device of the invention is particularly simple since it is made of only a small number of parts.

In addition the parts are very easy to assemble.

The device does not include any metal parts and is therefore easily recycled.

It provides well-sealed packaging and effective dispensing for the substance, and its main application lies in the fields of cosmetics or pharmaceuticals.

BRIEF DESCRIPTION OF THE DRAWINGS

The invention will be better understood on reading the following description, accompanied by drawings in which.

DETAILED DESCRIPTION OF THE PREFERRED EMBODIMENTS

Figures 1A, 1B, 1C:
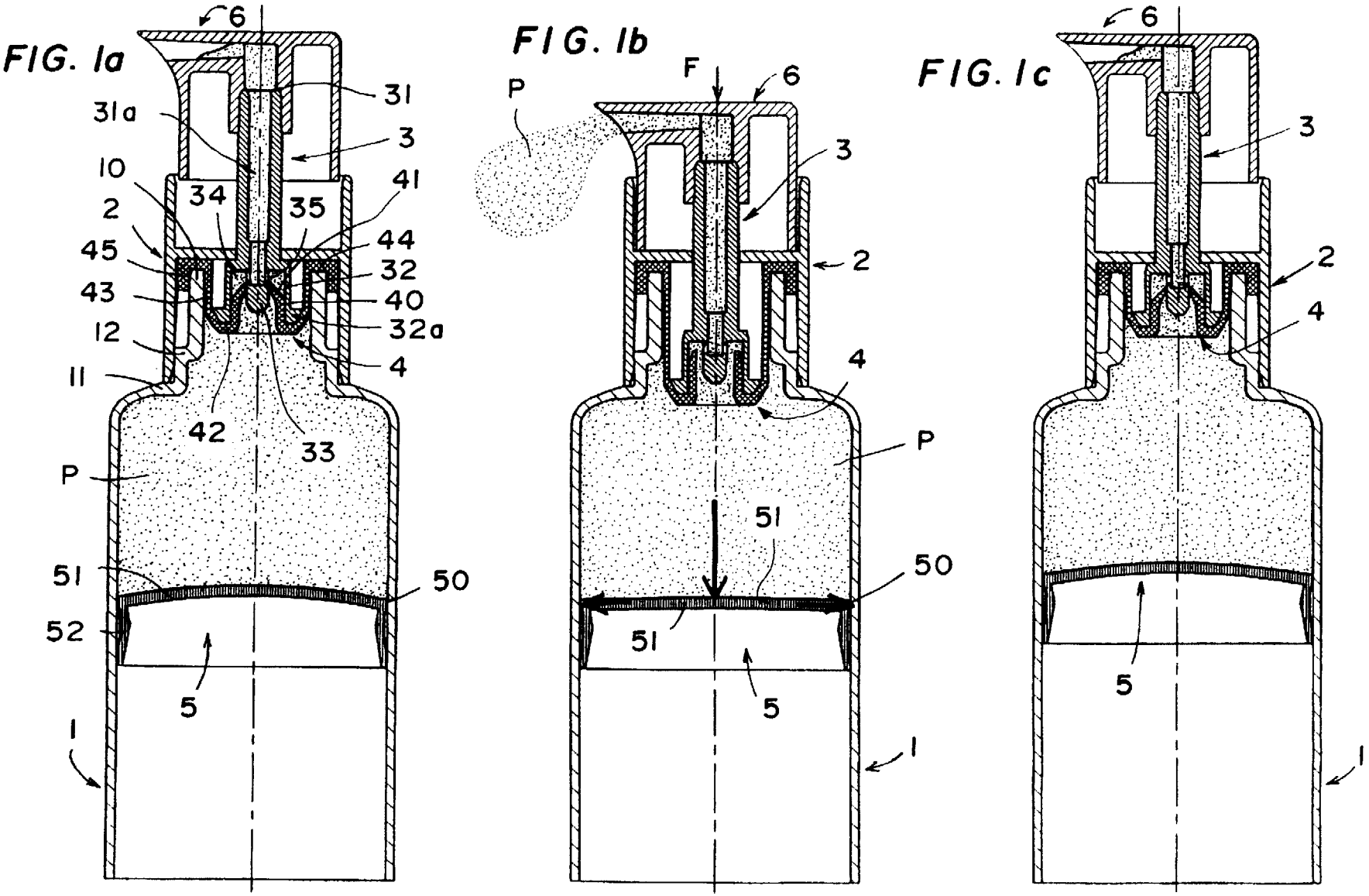
FIGS. 1*a*, 1*b*, and 1*c* are section views of a first embodiment of the device of the invention during different stages of operation.

The device shown in FIGS. 1*a*, 1*b*, and 1*c* is intended for packaging and dispensing a liquid or semi-liquid substance P. This substance may therefore be of high viscosity and it may be in the form of a cream.

The device comprises, in particular, means for compressing a substance P in a receptacle 1 in such a manner as to enable the substance P to be ejected.

Receptacle 1 is closed in a sealed manner, firstly at its top end by a cap 2 and secondly at its bottom end by an internally movable punt 5. A nozzle-forming tube 3 passes axially through cap 2. A top end 31 and an internal duct 31*a* of tube 3 project and open out to the outside.

Optionally, a dispensing endpiece 6 covers top end 31 of tube 3 above cap 2.

The means for compressing substance P inside receptacle 1 comprises an elastically deformable membrane 4.

Membrane 4 is pierced by a central ejection orifice 41 and is housed in top portion of receptacle 1.

Membrane 4 comprises an axial valve 40 that is substantially frustoconical with a top portion being provided with ejection orifice 41, a middle portion running into a channel section ring 42 and a thin stretchable skirt 43 connected to an annular flange 44. Skirt 43 extends upwards along an inside wall of receptacle 1. Annular flange 44 fixes membrane 4 to receptacle 1.

Annular flange 44 preferably has a shoulder 45 for fitting over a neck 10 of receptacle 1.

In this configuration, cap 2 covers neck 10, bearing against flange 44 and holding shoulder 45 of flange 44 captive between its own side wall and an outside face of neck 10.

Also, a bottom edge of cap 2 comes into abutment against a shoulder 11 on receptacle 1 and is engaged as a force-fit on a cylindrical bearing surface 12 formed on neck 10 of receptacle 1 above shoulder 11.

An internal bottom end of tube 3 is provided firstly with an element for bearing against membrane 4 and secondly with a closure element for closing ejection orifice 41.

The element for bearing against membrane 4 comprises a peripheral hood 32 surrounding the element for closing orifice 41.

A bottom edge of hood 32 includes a tapering rim 32*a* in bearing contact against ring 42.

Rim 32*a* is of width and diameter greater than a top portion of hood 32 so as to guarantee a uniform bearing force on ring 42.

The element for closing ejection orifice 41 comprises a central nose 33 which is surrounded by a cavity 34 communicating with internal duct 31*a* of tube 3 via at least one lateral opening 35.

Movable punt 5 comprises an element that can slide upwards toward tube 3 and is self-locking. The element is substantially cylindrical in shape. It comprises firstly a top wall 51 that is convex and elastically deformable, designed to be continuously in contact with substance 2, and secondly a peripheral side wall 52 designed to jam against an internal side surface of receptacle 1 so as to prevent punt 5 moving back downward.

A peripheral edge 50 of top wall 51 of movable punt 5 has a profile that serves both to scrape substance P on the internal side face of receptacle 1 as punt 5 slides upward and to seal the bottom of receptacle 1.

As shown in FIG. 1*b*, manual pressure F exerted on endpiece 6 moves tube 3 downward causing rim 32*a* of hood 32 to bear against ring 42, thus lengthening skirt 43 of membrane 4 and compressing substance P inside receptacle 1 by the piston effect exerted by ring 42.

The increased pressure established within substance P causes ejection orifice 41 to open around nose 33, cavity 34 to fill, and substance P to be expelled to the outside via the internal duct 31*a* of tube 3.

The quantity of substance dispensed is thus a direct function of the extent to which skirt 43 is lengthened.

The extra pressure established inside receptacle 1 also gives rise to elastic deformation and more specifically to flattening of convex top wall 51 of punt 5. This deformation acts on peripheral edge 50 of wall 51 causing it to press more firmly and thus prevent punt 5 from moving downwardly. Simultaneously, side wall 52 is retracted and temporarily ceases to be jammed.

When endpiece 6 is released, tube 3 rises, thereby releasing membrane 4 which then returns to its initial shape and position.

In this closed position, orifice 41 is again closed by nose 33.

Because a quantity of substance P has been expelled, return of membrane 4 gives rise to suction in receptacle 1 which is immediately compensated by punt 5 rising while remaining in contact with substance P.

Punt 5 slides upward in a guided manner by side wall 52 sliding over the internal side face of receptacle 1. This movement is made possible by the temporary absence of jamming and it is accompanied by scraping of the internal side face of receptacle 1.

As membrane 4 returns to its closure position, punt 5 returns to its initial shape and the jamming of side wall 52 reappears, thereby locking punt 5 in its new equilibrium position.

Figure 2:
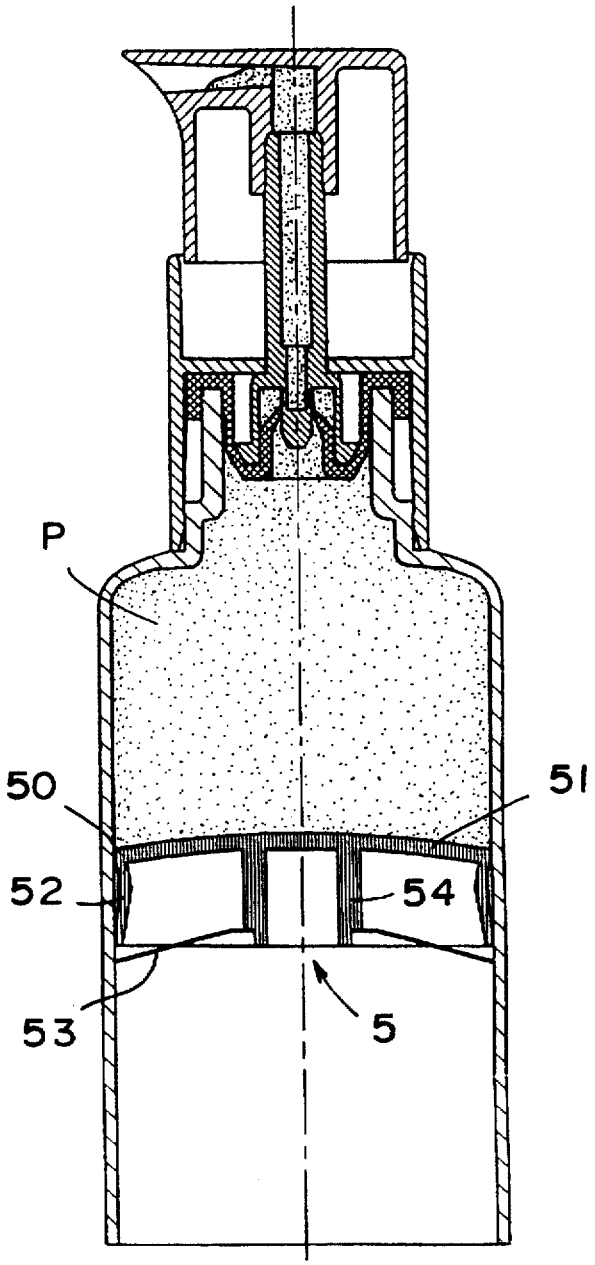
FIG. 2 is a section view of a second embodiment of the device of the invention.

In the embodiment shown in FIG. 2, movable punt 5 also includes, beneath top wall 51, a set of downwardly sloping flexible blades 53. The free ends of blades 53 bear against the internal face of receptacle 1 to reinforce retention of punt 5 in its locking position.

The set of blades 53 is fixed to a central hub 54 secured to top wall 51 and projected downward.

We claim:

1. A device for packaging and dispensing a liquid or semi-liquid substance (P), comprising:

a receptacle including a top and a bottom; the top closed in a sealed manner firstly by a cap (2) and the bottom closed by an internally movable punt (5);

means for compressing the substance including an elastically deformable membrane (4) received in the top of the receptacle (1), said membrane (4) including a substantially frustocononical axial valve (40); a top portion provided with a central ejection orifice (41), a middle portion terminating at a channel section ring (42) and provided with a stretchable thin skirt (43) connected to a flange (44), said skirt (43) extending upwards along an internal wall of the receptacle (1) and said flange (44) arranged to cooperate with the receptacle so as to fix the membrane (4) to the receptacle (1); and a nozzle-forming tube (3) passing axially through the cap (2) of the receptacle (1), said tube (3) having a top end (31) projecting outside the receptacle (1), an internal bottom end provided with an element (32*a*) for bearing against the membrane (4) and a closure element (33) for cooperating with axial valve (40) of the membrane (4) for closing the ejection orifice (41).

2. A device for packaging and dispensing a liquid or semi-liquid substance (P) according to claim 1, wherein said cap (2) covers the top of the receptacle (1) such that the flange (44) is held between the cap (2) and the receptacle (1) for fixing the membrane (4) to the receptacle (1).

3. A device for packaging and dispensing a liquid or semi-liquid substance (P) according to claim 1, wherein said element for bearing against the membrane (4) further includes a peripheral hood (32) surrounding the closure element.

4. A device for packaging and dispensing a liquid or semi-liquid substance (P) according to claim 3, wherein said hood (32) has a bottom edge which includes a tapering rim (32*a*).

5. A device for packaging and dispensing a liquid or semi-liquid substance (P) according to claim 1, wherein said closure element for closing the ejection orifice (41) comprises a central nose (33) surrounded by a cavity (34) which communicates with an internal duct (31*a*) of the tube (3) via a lateral opening (35).

6. A device for packaging and dispensing a liquid or semi-liquid substance (P) according to claim 1, wherein said movable punt (5) comprises an element that is slidable towards the tube (3) and is self locking in the receptacle against reverse motion, said element being substantially cylindrical having a convex and elastically deformable top wall (51) arranged so as to be continuously in contact with the substance (P) and having a peripheral side wall (52) arranged so as to frictionally jam against an internal side face of the receptacle (1) to provide the self-locking effect.

7. A device for packaging and dispensing a liquid or semi-liquid substance (P) according to claim 6, wherein said top wall (51) of the movable punt (5) has a peripheral edge (50) with a profile that serves to scrape the substance (P) on the internal side face of the receptacle (1) when the punt (5) slides toward the tube (3) and serves to seal the bottom of the receptacle (1).

8. A device for packaging and dispensing a liquid or semi-liquid substance (P) according to claim 6, wherein said movable punt (5) further comprises a set of downwardly sloping flexible blades (53) beneath the top wall (51), said blades having ends which bear against the internal side face of the receptacle (1) to reinforce the locking of the punt (5).

9. A device for packaging and dispensing a liquid or semi-liquid substance (P) according to claim 1, wherein said top end (31) of the tube (3) is covered by a dispensing endpiece (6).

* * * * *